US007118434B2

(12) United States Patent
Arvidsson et al.

(10) Patent No.: US 7,118,434 B2
(45) Date of Patent: Oct. 10, 2006

(54) OUTBOARD DRIVE FOR BOATS

(75) Inventors: Lennart Arvidsson, Kållered (SE); Staffan Månsson, Myggenäs (SE)

(73) Assignee: AB Volvo Penta, Gothenburg (SE)

( * ) Notice: Subject to any disclaimer, the term of this patent is extended or adjusted under 35 U.S.C. 154(b) by 0 days.

(21) Appl. No.: 10/513,304

(22) PCT Filed: Apr. 29, 2003

(86) PCT No.: PCT/SE03/00691

§ 371 (c)(1),
(2), (4) Date: May 17, 2005

(87) PCT Pub. No.: WO03/093106

PCT Pub. Date: Nov. 13, 2003

(65) Prior Publication Data

US 2005/0202735 A1 Sep. 15, 2005

(30) Foreign Application Priority Data

May 3, 2002 (SE) ..... 0201341

(51) Int. Cl.
*F02B 61/04* (2006.01)

(52) U.S. Cl. ..... 440/88 C

(58) Field of Classification Search ..... 440/53, 440/88 C, 88 HE

See application file for complete search history.

(56) References Cited

U.S. PATENT DOCUMENTS 1,840,948 A * 1/1932 Harvey ..... 440/63
3,452,704 A * 7/1969 Watkins ..... 440/57
3,707,939 A * 1/1973 Berg ..... 440/58
4,040,378 A * 8/1977 Blanchard ..... 440/52
5,002,593 A * 3/1991 Ichishita et al. ..... 96/137
5,487,688 A 1/1996 Sumigawa
6,561,859 B1 * 5/2003 Towner et al. ..... 440/112

FOREIGN PATENT DOCUMENTS

SE 514363 2/2001

* cited by examiner

*Primary Examiner*—Stephen Avila
(74) *Attorney, Agent, or Firm*—Young & Thompson

(57) ABSTRACT

Outboard drive unit for boats, including an underwater housing (6), in which two propeller shafts (7, 8) are mounted and are driven via a first bevel gearing (19, 20, 21) enclosed in the underwater housing, and a second bevel gearing (13, 14, 15) enclosed in a gear housing (11). With the aid of a mounting element (23) joined to the underwater housing and the gear housing, the drive unit can be mounted in an opening (2) in the bottom (1) of a boat hull, with the underwater housing on the outside and the gear housing on the inside of the hull. The mounting element forms a housing which defines, firstly, an oil reservoir (33) for the oil of the drive unit and, secondly, a surrounding chamber (36) through which engine cooling water flows and which is used for cooling the oil in the reservoir.

8 Claims, 1 Drawing Sheet

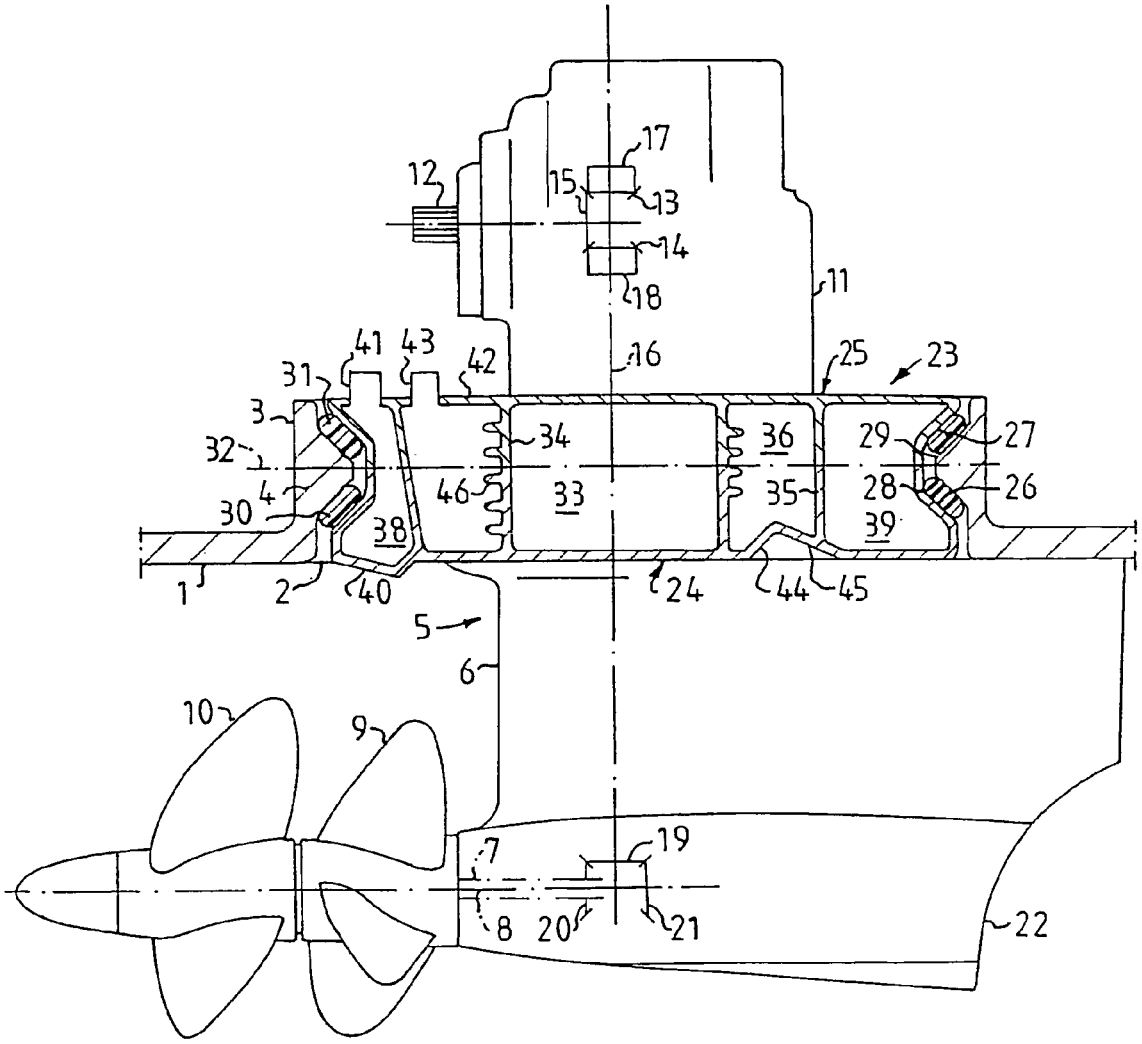
17
12
15
13
14
18
11
41
43
42
16
25
23
31
3
34
36
29
27
32
4
46
33
35
28
26
30
38
39
1
2
40
24
44
45
5
6
10
9
19
7
8
20
21
22

OUTBOARD DRIVE FOR BOATS

The present invention relates to an outboard drive unit for boats for boats for driving at least one propeller, comprising, firstly, an underwater housing in which a drive shaft, which in the operating state of the drive unit is essentially vertical, is rotatably mounted and which, via a bevel gearing is drivably coupled at a lower end to at least one propeller shaft mounted in the underwater housing, and, secondly, a gear housing joined to the underwater housing and enclosing a second bevel gearing, via which the upper end of said essentially vertical drive shaft is drivably coupled to an at least substantially horizontal shaft, and mounting elements for mounting the drive unit with the underwater housing on the outside and the gear housing on the inside of a boat hull.

The upper horizontal shaft of a propeller drive of the above described type is intended to be coupled to the output shaft from a driving engine. The bevel gearing which drivably connects the horizontal shaft to the vertical drive shaft is, in a known drive unit of the type in question, combined with a reversing transmission, comprising wet disc clutches, the oil of which, which is also used as lubricating oil for both the upper bevel gearing in said gear housing and the lower bevel gearing in the underwater housing, needs to be cooled during the operation. For cooling this oil, there has up to now been used an oil cooler separated from the oil cooler to the engine lubricating oil system. The oil cooler has been arranged in the boat engine compartment and see water has been pumped through it to cool the oil circulating through the cooler.

Such an oil cooler requires a certain amount of space in the engine compartment and requires hoses connecting to the inlet and outlet for both oil and cooling water. The risk for leakage increases with the length of the hoses and the number of connections.

The purpose of the present invention is in general to eliminate the need for a separate oil cooler installation for the transmission components of the drive unit to thereby i.a. reduce costs, save space in the engine compartment and to reduce the risk of leakage.

This is achieved according to the invention by virtue of the fact that a lubricant chamber is disposed between the underwater housing and the gear housing, said chamber being bounded by a space through which surrounding water flows.

The oil space between the underwater housing and the gear housing with the surrounding space through which water flows has proved to function as an effective oil cooler integrated in the drive unit. The water following in the surrounding space can be seawater, which, in a known manner, circulates through the coolant casing of the engine or through a separate heat exchanger, if the engine is cooled by fresh water, and which is then released through an outlet in the hull. Alternatively, the water flowing in the surrounding space can be outgoing coolant water, so-called "by-pass"-water, which is released through the engine exhaust pipe. The solution according to the invention eliminates the need for a separate space-consuming oil cooler for the drive unit in the engine compartment at the same time as the number of hoses and connectors is reduced to a minimum.

In a preferred embodiment of an outboard drive unit according to the invention, which has mounting elements in the form of a lower housing portion joined to the underwater housing and/or the gear housing and an upper housing portion, which are intended to be clamped tightly against each other on either side of a mounting flange about an opening in the boat bottom, said upper and lower housing portions defining the lubricating oil compartment and the space through which water flows.

Preferably, the lubricating oil space is placed centrally in the housing and is surrounded by the space through which water flows. To achieve maximum coolant effect, it is advantageous if the dividing wall between these spaces is provided with cooling flanges.

The invention will be described in more detail below with reference to the example shown in the accompanying drawing, where the FIGURE shows schematically a partially cut away side view of one embodiment of an outboard drive unit according to the invention.

In the FIGURE, 1 designates a bottom of a boat hull, which can be of cast fibreglass reinforced polyester plastic. The hull bottom 1 is provided with an opening 2, which is surrounded by a vertical well 3, which extends up into the interior of the hull. The well 3 is preferably cast in one piece with the bottom 1 and is provided with an inwardly directed peripheral flange 4, which in the example shown, has a substantially triangular cross section.

The well 3 with the flange 4 forms a mounting arrangement for a propeller drive unit generally designated 5, which in the example shown has an underwater housing 6, in which two concentric propeller shafts 7 and 8 with individual propellers 9 and 10, respectively, are rotatably mounted. The underwater housing 6 is joined to the upper gear housing 11, in which a horizontal drive shaft 12 is rotatably mounted. The shaft 12 is intended to be coupled to an output shaft from a liquid-cooled internal combustion engine (not shown). The shaft 12 drives, via a bevel gearing comprising bevel gears 13, 14 and 15 and enclosed in the gear housing 11, a vertical shaft 16. The gears 13 and 14 are rotatably mounted on the shaft 16 and are alternately lockable on the shaft by means of individual multi-disc wet disc clutches 17 and 18, respectively, for driving the shaft 16 in one rotational direction or the other. Via a bevel gearing enclosed in underwater housing 6 and comprising bevel gears 19, 20 and 21, the shaft 16 drives the propeller shafts 7 and 8 in opposite rotational directions. In the example shown, the propellers 9 and 10 are pulling propellers disposed in front of the underwater housing 6, in the aft end of which there is an exhaust port 22.

Between the underwater housing 6 and the upper gear housing 11, there is a mounting element, generally designated 23, which consists, on the one hand, of a lower bowl-shaped housing portion 24, which can be cast in one piece with the underwater housing 6 or be rigidly joined in another suitable manner to the underwater housing 6 and/or the gear housing 11, and, on the other hand, an upper bowl-shaped housing portion 25, which, in a manner not shown in more detail here, e.g. by means of screws, is rigidly joined to the lower housing portion 23. Between conical surfaces 26 and 27 on the respective housing portions 24 and 25 and corresponding opposite conical surfaces 28 and 29 on the flange 4, there are upper and lower rings 30 and 31 of flexible material, e.g. rubber, clamped for sealed and vibration-damped mounting of the drive unit in the boat hull.

In the FIGURE, 32 designates the sectional plane between the housing portions 24 and 25, which are clamped against each other, so as to achieve a sealed connection. Possible seals required in the sectional plane have not been shown. The housing 23 formed of the housing portions 24 and 25, forms at the same time the mounting element for the drive unit in the hull and defines a centrally placed oil reservoir 33, which has a surrounding lateral wall 34 and communicates, in a manner not shown in more detail here, with the gear housing 11 and the underwater housing 6. An additional lateral wall 35 surrounds the lateral wall 34 at a distance therefrom so that an annular chamber 36 is formed which surrounds the oil reservoir 33. The surrounding outer wall 35 of the chamber 36, which delimits the chamber 36 from an engine cooling water intake 38 and from a passage 39 for exhaust to the exhaust port 22.

The cooling water intake 38 has an inlet opening 40 for seawater and a hose connection 41 for connection to the coolant water circuit (not shown) of the engine. In the example shown, it is not the incoming cooling water but instead "by-pass" water, i.e. the minor portion of the total amount of engine coolant water which is used for cooling the engine exhaust pipe, flowing through the chamber 36. For this purpose, the chamber 36 is provided, in an upper wall 42, with inlet 43 for said "by-pass" water. The water in the chamber 36 is let out through a pair of outlet ports 44 (one shown) placed symmetrically on either side of a centre plane of the underwater housing in a lower wall portion 45 of the chamber.

As can be seen in the FIGURE, the port 44 is directed obliquely aft and the wall portion 45 is made to form a sort of nozzle. As is further evident from the FIGURE, the inlet opening 40 for the coolant intake 38 is placed substantially above the aft propeller 9, while the outlet 44 with the nozzle 45 is located relatively far aft of the propellers 9, 10. The current tube generated by the pulling propellers past the outlet will, in the arrangement described of the outlet opening and the nozzle, create an underpressure, which contributes to sucking water out of the chamber 36. This means that sufficient circulation of cooling water through the chamber 36 for the cooling need in question, can be achieved without using an extra pump arrangement. To maximize the cooling effect, in the example shown, the wall 34 to the oil reservoir 33 is, however, provided with cooling flanges 46.

As an alternative to the arrangement described, which uses a portion of the engine output coolant water as an oil cooling medium, the incoming coolant water or a combination of input and output coolant water can be used.

The invention claimed is:

1. Outboard drive unit for boats for driving at least one propeller, comprising, firstly, an underwater housing (6) in which a drive shaft (16), which in the operating state of the drive unit is essentially vertical, is rotatably mounted and which, via a bevel gearing (19, 20, 21) is drivably coupled at a lower end to at least one propeller shaft (7, 8) mounted in the underwater housing, and, secondly, a gear housing (11) joined to the underwater housing and enclosing a second bevel gearing (13, 14, 15), via which the upper end of said essentially vertical drive shaft is drivably coupled to an at least substantially horizontal shaft (12), and mounting elements (23) for mounting the drive unit with the underwater housing on the outside and the gear housing on the inside of a boat hull, characterized in that a lubricating oil chamber (33) is arranged between the underwater housing (6) and the gear housing (11), said chamber being bounded by a space (36) through which surrounding water flows.

2. Outboard drive unit according to claim 1, characterized in that said mounting element (23) forms a housing intended to be fixed in an opening (2) in a boat bottom (1), said housing defining the lubricating oil space (33) and the space (36) through which water flows.

3. Outboard drive unit according to claim 2, characterized in that the space (36), through which water flows, has an inlet (43) disposed to be connected to a conduit from an engine coolant circuit and an outlet (44, 45) for releasing engine coolant water to the surrounding water.

4. Outboard drive unit according to claim 3, characterized in that said propeller shaft (7, 8) has a forwardly directed end, which supports a pulling propeller (9, 10) and that said mounting element (23) has, in an area above the propeller, a cooling water intake (40) for supplying water to the engine coolant circuit and, in an area above and aft of the propeller, the outlet (44, 45) for letting out a portion of the cooling water sucked in through the cooling water intake.

5. Outboard drive unit according to claim 2, characterized in that the lubricating oil space (339 is placed centrally in the housing (23) and is surrounded by the space (36) through which water flows, and that a dividing wall (34) between said spaces is provided with cooling flanges (46).

6. Outboard drive unit according to claim 3, characterized in that the outlet (44, 45) is formed and directed so that an underpressure arises in the outlet as the drive unit moves through the water when driving forward.

7. Outboard drive unit according to claim 2, characterized in that said housing (23), which forms the mounting element, comprises a lower housing portion (24) joined to the underwater housing (6) and/or the gear housing (11) and an upper housing portion (25), which are intended to be clamped against each other on either side of a mounting flange (4) about an opening (2) in a boat hull.

8. Outboard drive unit according to claim 4, characterized in that two counter-rotating, concentric propeller shafts (7, 8), each having a pulling propeller (9, 10), are mounted in the underwater housing (6).

* * * * *